US012584627B2

(12) United States Patent
Østergård et al.

(10) Patent No.: US 12,584,627 B2
(45) Date of Patent: Mar. 24, 2026

(54) NICKEL-BASED ALLOY WITH A SLURRY COATING, WITH HIGH RESISTANCE TO METAL DUSTING

(71) Applicants: Topsoe A/S, Kgs. Lyngby (DK); National Institute for Aerospace Technology (INTA), Torrejón de Ardoz (ES)

(72) Inventors: Maria José Landeira Østergård, Virum (DK); Alina Agüero Bruna, Torrejón de Ardoz (ES); Marcos Gutiérrez Del Olmo, Torrejón de Ardoz (ES); Søren Gyde Thomsen, Kgs. Lyngby (DK)

(73) Assignees: Topsoe A/S, Kgs. Lyngby (DK); National Institute for Aerospace Technology (INTA), Torrejón de Ardoz (ES)

( * ) Notice: Subject to any disclaimer, the term of this patent is extended or adjusted under 35 U.S.C. 154(b) by 129 days.

(21) Appl. No.: 18/192,463

(22) Filed: Mar. 29, 2023

(65) Prior Publication Data

US 2023/0280028 A1 Sep. 7, 2023

Related U.S. Application Data

(63) Continuation of application No. 16/645,560, filed as application No. PCT/EP2018/074919 on Sep. 14, 2018, now Pat. No. 11,739,932.

(30) Foreign Application Priority Data

Sep. 22, 2017 (ES) ..... ES201731139

(51) Int. Cl.
*F23D 14/24* (2006.01)
*C23C 12/00* (2006.01)
*F23D 14/58* (2006.01)

(52) U.S. Cl.
CPC ..... *F23D 14/24* (2013.01); *C23C 12/00* (2013.01); *F23D 14/58* (2013.01); *F23D 2212/20* (2013.01); *F23D 2213/00* (2013.01)

(58) Field of Classification Search
CPC ..... F23D 14/24; F23D 14/58; F23D 2212/20; F23D 2213/00; C23C 12/00
USPC ..... 431/354
See application file for complete search history.

(56) References Cited

U.S. PATENT DOCUMENTS

| | | | | |
|---|---|---|---|---|
| 3,918,925 A | | 11/1975 | McComas | |
| 4,486,245 A | | 12/1984 | Chigasaki | |
| 5,350,599 A | * | 9/1994 | Rigney | C23C 14/228 427/255.7 |
| 5,366,765 A | * | 11/1994 | Milaniak | C23C 10/20 427/237 |
| 5,409,748 A | | 4/1995 | Song et al. | |
| 5,478,413 A | | 12/1995 | Mosser et al. | |
| 5,547,770 A | | 8/1996 | Meelu et al. | |
| 5,795,659 A | | 8/1998 | Meelu et al. | |
| 6,146,696 A | | 11/2000 | Das et al. | |

(Continued)

FOREIGN PATENT DOCUMENTS

| | | |
|---|---|---|
| CN | 1219607 A | 6/1999 |
| CN | 1278020 A | 12/2000 |

(Continued)

*Primary Examiner* — Avinash A Savani
(74) *Attorney, Agent, or Firm* — Blank Rome LLP

(57) ABSTRACT

A nickel-based alloy is coated with a silicate based nickel aluminide slurry diffusion coating.

4 Claims, 3 Drawing Sheets

(56) References Cited

U.S. PATENT DOCUMENTS

| | | | | |
|---|---|---|---|---|
| 6,428,630 | B1 | 8/2002 | Mor et al. | |
| 10,040,951 | B2 | 8/2018 | Risseeuw et al. | |
| 10,344,970 | B2 | 7/2019 | Ekman et al. | |
| 2003/0175544 | A1 | 9/2003 | Ramanarayanan et al. | |
| 2004/0058189 | A1 | 3/2004 | Hodgens et al. | |
| 2004/0126496 | A1* | 7/2004 | Ackermann | C23C 10/28 427/379 |
| 2004/0214025 | A1 | 10/2004 | Ackerman et al. | |
| 2005/0031781 | A1* | 2/2005 | Kool | C23C 10/30 427/430.1 |
| 2005/0070431 | A1 | 3/2005 | Alvin | |
| 2007/0298269 | A1* | 12/2007 | Kool | C23C 10/18 428/457 |
| 2008/0202552 | A1 | 8/2008 | Kool et al. | |
| 2009/0169750 | A1 | 7/2009 | Wilkins | |
| 2009/0202717 | A1 | 8/2009 | Morra et al. | |
| 2009/0293446 | A1 | 12/2009 | Etemad | |
| 2010/0032472 | A1 | 2/2010 | Heinecke | |
| 2011/0305921 | A1* | 12/2011 | Raybould | C23C 28/345 428/448 |
| 2012/0036858 | A1 | 2/2012 | Lacy et al. | |
| 2015/0090154 | A1 | 4/2015 | Belov et al. | |
| 2016/0298839 | A1 | 10/2016 | Ekman et al. | |
| 2018/0058228 | A1 | 3/2018 | Berger | |

FOREIGN PATENT DOCUMENTS

| | | | |
|---|---|---|---|
| CN | 1497065 | A | 5/2004 |
| CN | 1643173 | A | 7/2005 |
| CN | 101195914 | A | 6/2008 |
| CN | 101952481 | A | 1/2011 |
| CN | 102682987 | A | 9/2012 |
| CN | 103572201 | A | 2/2014 |
| CN | 104341137 | A | 2/2015 |
| CN | 105102114 | A | 11/2015 |
| CN | 106051767 | A | 10/2016 |
| EP | 0 903 424 | A1 | 3/1999 |
| EP | 1 065 296 | A1 | 1/2001 |
| EP | 2 730 679 | A1 | 5/2014 |
| WO | WO 94/25206 | A1 | 11/1994 |
| WO | WO 95/23915 | A1 | 9/1995 |
| WO | WO 2015/000675 | A1 | 1/2015 |
| WO | WO 2016/124567 | A1 | 8/2016 |

* cited by examiner

NICKEL-BASED ALLOY WITH A SLURRY COATING, WITH HIGH RESISTANCE TO METAL DUSTING

CROSS REFERENCE TO RELATED APPLICATIONS

This is a continuation of U.S. patent application Ser. No. 16/645,560, filed Mar. 9, 2020, which is a national stage of PCT/EP2018/074919, filed Sep. 14, 2018, which claims priority to Spanish Application No. P 201731139, filed Sep. 22, 2017, the entire contents of which are incorporated herein by reference.

FIELD OF THE INVENTION

The present invention is directed to combustion of hydrocarbon fuel and in particular to a burner with a slurry applied nickel aluminide diffusion coating for use in hydrocarbon fuelled combustion reactors i.e. catalytic reactors.

BACKGROUND

Burners of a combustion reactant are mainly used for firing gas-fuelled industrial furnaces and process heaters, which require a stable flame with high combustion intensities. Conventionally designed burners include an outer burner tube with a central burner tube for fuel supply surrounded by an oxidiser supply port. Intensive mixing of fuel and oxidiser in a combustion zone is achieved by passing the oxidiser through a swirler installed at the burner face on the central burner tube. The stream of oxidiser is, thereby, given a swirling-flow, which provides a high degree of internal and external recirculation of combustion products and high combustion intensity.

As a general drawback of conventional swirling-flow burners of the above design, the burner face is at high gas flow velocities, as required for industrial burners of this design, exposed to overheating caused by the high degree of internal recirculation along the central axis of the combustion zone. Hot combustion products thereby flow back towards the burner face, which results in rapid heating up to high temperatures and, consequently, degradation of the face due to the larger aggressiveness of the recirculating gas.

A swirling burner for use in small and medium scale applications with substantially reduced internal recirculation of combustion products toward the burner face is disclosed in U.S. Pat. No. 5,496,170. The burner design disclosed in this patent results in a stable flame with high combustion intensity and without detrimental internal recirculation of hot combustion products by providing the burner with a swirling-flow of oxidiser having an overall flow direction concentrated along the axis of the combustion zone and at the same time directing the fuel gas flow towards the same axis. The disclosed swirling-flow burner comprises a burner tube and a central oxidiser supply tube concentric with and spaced from the burner tube, thereby defining an annular fuel gas channel between the tubes, the oxidiser supply tube and the fuel gas channel having separate inlet ends and separate outlet ends. U-shaped oxidiser and fuel gas injectors are arranged coaxial at the burner face. The burner is further equipped with a bluff body with static swirler blades extending inside the oxidiser injector. The swirler blades are mounted on the bluff body between their upstream end and their downstream end and extend to the surface of the oxidiser injection chamber.

US2002086257 discloses a swirling-flow burner with a burner tube comprising a central oxidiser supply tube and an outer concentric fuel supply tube, the oxidiser supply tube being provided with a concentric cylindrical guide body having static swirler blades and a central concentric cylindrical bore, the swirler blades extending from outer surface of the guide body to inner surface of oxidiser supply tube being concentrically arranged within space between the guide body and inner wall at lower portion of the oxidiser supply tube.

Despite the above mentioned attempts to overcome the problem of degradation of the burner, the burners of the known art design have been known to be challenged in cases where the operating conditions are particularly difficult. The problems experienced in those cases has been degradation of the oxidant nozzle edge of the tube.

To address these problems, known art suggests the use of a variety of coatings. Accordingly, U.S. Pat. No. 6,284,324 discloses method for protecting a synthesis gas generator burner heat shield by coating the burner heat shield with an overlay alloy coating composition of the formula MCrAlY wherein M is selected from the group consisting of iron, nickel, and cobalt. In a preferred embodiment, the coating includes from about 20-40 weight percent Co, 5-35 weight percent Cr, 5-10 weight percent Ta, 0.8-10 weight percent Al, 0.5-0.8 Y, 1-5 weight percent Si and 5-15 weight percent $Al_2O_3$.

In US2010285415 a burner element is provided. The burner element includes a surface that potentially comes into contact with a fuel. The surface potentially coming into contact with the fuel has a coating including aluminum oxide. A burner including the burner element is also provided. Further, a method for coating a surface of a burner element potentially coming into contact with a fuel is described, wherein the surface potentially coming into contact with the fuel is coated with aluminum oxide.

According to the invention described in WO09095144, a ceramic layer is to be applied on the metal surface of a burner part facing the flame side of a burner for a gasification reactor that is fuelled with solid or liquid fuel, wherein special embodiments relate to the application of even a plurality of ceramic layers by means of the application technique of plasma spraying, particularly the materials zirconium/yttrium oxide. The service life of the burner is increased by the described coating of the burner cooling parts. Thus the availability of the system is increased while at the same time minimizing the maintenance effort. Additionally, less expensive metal materials can be used. Due to a higher permissible temperature of the supplied oxidizing agent, an increase in efficiency of the gasification process is possible.

In DE102005046198, a burner for an industrial oven or furnace has a first feed pipe for fuel gas and a second feed pipe for oxygen. Parts of the burner head are fabricated of cobalt-based alloy with an aluminum coating. Further claimed is a process to fabricate the burner head in which the cobalt/alloy components are annealed, forming an aluminum-rich surface layer.

Despite the solutions disclosed in the above mentioned known art a need still exists to provide protection to Ni-based alloys when these are subject to high temperature corrosion caused by metal dusting as is the case for burners for combustion of hydrocarbon fuel in hydrocarbon fuelled combustion reactors.

SUMMARY OF THE INVENTION

Thus, the main object of the invention is to obtain an increased resistance against high temperature corrosion caused by metal dusting, advantageously for use in burners made of Ni base alloys which overcome the mentioned problems.

Accordingly, this invention is a burner with a coating on at least a part of the burner, where the coating is a nickel aluminide diffusion coating applied by a Cr (VI) free, silicate based aluminium slurry.

The coating may provide a significant increase in lifetime of the equipment. In some examples an increase of lifetime of the component from 2 months to more than 2 years has been observed.

DETAILED DESCRIPTION OF THE PREFERRED EMBODIMENTS

Figure 1:
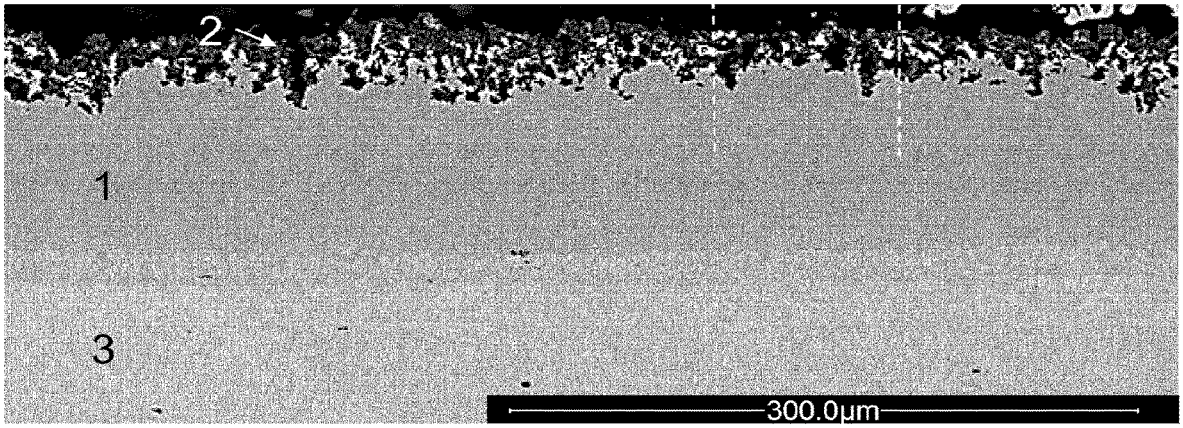
FIG. 1 shows a cross section of a sample after a five week metal dusting test.

In an embodiment of the invention the Ni base burner for a catalytic reactor comprises at least two concentric burner tubes for oxidizer and fuel supply. According to this embodiment of the invention, at least a part of one or both the burner tubes is coated with an aluminide slurry diffusion coating. Although the invention advantageously is for use in large-scale burners with relative large burner tube diameters, the invention is not restricted to these large diameters, since an advantage of the invention is that the slurry diffusion coating may be applied inside relative small diameter burner tubes.

In a further embodiment of the invention, the nickel aluminide slurry diffusion coating has a thickness of 10-1000 μm. Phase stability depends on coating thickness and exposed temperature. In a further embodiment the coating thickness is at least 100 μm. The burner tubes are in a further embodiment of the invention made of a Ni-based alloy. The invention is well suited for substrates with Ni-based alloys, as one of the advantages of the coating is that the interdiffusion of Ni in the coating and Al in the coated part of the burner is slower and to a much lower extent than the disclosed known art coatings.

The burner is in a further embodiment coated with a silicate based nickel aluminide slurry diffusion coating by applying a 10-1000 μm thick silicate based Al containing slurry on at least one of the burner tubes or at least a part of the burner tube(s). The application of the slurry can be done by means of spraying, brushing or immersion. Further the coating must be done by a subsequent heat treatment of the applied silicate based Al containing slurry. The heat treatment may be performed in an oven where the coated burner parts are heated separately, or it may be performed locally on the assembled burner, for instance in situ in the catalytic reactor. This is especially advantageous for large-scale burners.

In an embodiment of the invention, the heat treatment is performed in two steps as a diffusion heat treatment. The first heat treatment step is a ½-2 hour, preferably 1-hour diffusion heat treatment at 600° C.-800° C., preferably 700° C. The following second step is a 2-11 hour, preferably 10-hour diffusion heat treatment at 900° C.-1200° C., preferably 1050° C. The two step diffusion heat treatment may in another embodiment of the invention be performed in a reducing atmosphere containing 90% Argon and 10% Hydrogen. The controlled heat treatment prior to exposure to process conditions leads to formation of a uniform and protective metal coating.

In a second aspect, the invention comprises a method for production of a silicate based nickel aluminide slurry coating on a Ni-based alloy for protection against high temperature corrosion caused by metal dusting, said method comprising the steps of

- applying a 10-1000 μm thick silicate based Al containing slurry on a Ni-based alloy
- heat treating the Ni-based alloy with the applied silicate based Al containing slurry in a first step diffusion heat treatment for ½-2 hour, preferably 1 hour at 600° C.-800° C., preferably 700° C. . . .
- heat treating the Ni-based alloy with the applied silicate based Al containing slurry in a second step diffusion heat treatment for 2-11 hour, preferably 10 hours at 900° C.-1200° C., preferably 1050° C.

In an embodiment of this aspect of the invention, the slurry is applied on Ni-based alloy by means of slurry spray, paint brush or immersion. The Ni-based alloy may in further embodiments of the invention be a catalytic reactor burner tube.

More specifically, an aspect of the invention comprises the use of a silicate based nickel aluminide diffusion coating on a burner tube in a catalytic reactor burner in the temperature interval 400° C. to 900° C., at a carbon activity higher than 1.

Summarizing, the advantages of the invention as described in the above aspects and embodiments comprise:

- the coating is produced from a water based slurry, free of Cr (VI) free and environmentally benign.
- It can be applied to large surfaces and inside thin burner tubes.
- Interdiffusion of Ni in the coating and Al in the substrate will be slower. Continuous diffusion of Ni into the coating and of Al into the metal alloy is a known problem, but the particular composition according to the invention shows the lowest interdiffusion in the relevant temperature interval.
- The controlled heat treatment prior to exposure to process conditions leads to formation of a uniform and protective metal coating.

Features of the Invention.

1. Burner for a catalytic reactor comprising at least two concentric burner tubes for oxidizer and fuel supply, wherein at least a part of at least one of said burner tubes is coated with a based nickel aluminide slurry diffusion coating.
2. Burner according to feature 1, coated with a silicate based nickel aluminide slurry diffusion coating.
3. Burner according to feature 2, wherein the silicate based nickel aluminide slurry diffusion coating has a thickness of between 10-1000 μm.
4. Burner according to any of the preceding features, wherein the burner tubes are made of a Ni-based alloy.
5. Burner according to feature 4, wherein the silicate based nickel aluminide slurry diffusion coating is made by applying a 10-1000 μm thick silicate based Al containing slurry on at least one of the burner tubes.
6. Burner according to feature 5, wherein the 10-1000 μm thick silicate based Al containing slurry is applied on at least one of the burner tubes by means of slurry spray, paint brush or immersion.

7. Burner according to feature 5 or 6, wherein the silicate based nickel aluminide slurry diffusion coating is made by a heat treatment of the applied silicate based Al containing slurry.
8. Burner according to feature 9, wherein the heat treatment is a two-step diffusion heat treatment in vacuum, first step is a ½-2 hour, preferably 1-hour diffusion heat treatment at 600° C.-800° C., preferably 700° C. and the following second step is a 2-11 hour, preferably 10-hour diffusion heat treatment at 900° C.-1200° C., preferably 1050° C.
9. Burner according to feature 8, wherein the heat treatment is performed in a reducing atmosphere of 80-100% Argon and 0-20% Hydrogen.
10. Method for production of a silicate based nickel aluminide slurry coating on a Ni-based alloy of a burner for protection against high temperature corrosion caused by metal dusting, said method comprising the steps of applying a 10-1000 μm thick silicate based Al containing slurry on the Ni-based alloy heat treating the Ni-based alloy with the applied silicate based Al containing slurry in a first step diffusion heat treatment in vacuum for ½-2 hour, preferably 1 hour at 600° C.-800° C., preferably 700° C. . . .

heat treating the Ni-based alloy with the applied silicate based Al containing slurry in a second step diffusion heat treatment in vacuum for 2-11 hour, preferably 10-hour at 900° C.-1200° C., preferably 1050° C.

11. Method according to feature 10, wherein the slurry is applied on Ni-based alloy of a burner by means of slurry spray, paint brush or immersion.
12. Method according to feature 10 or 11, wherein said Ni-based alloy is a catalytic reactor burner tube.
13. Use of a silicate based nickel aluminide diffusion coating on a burner tube in a catalytic reactor burner in the temperature interval 400° C. to 900° C., at a carbon activity higher than 1.

Position Numbers

01. Coating
02. Coating surface
03. Ni-based alloy

FIG. 1 shows the cross section of a sample after 5 weeks' metal dusting test. Position 1 is the coating, and position 2 is oxides formed on the coating, whereas position 3 is the base alloy. No metal dusting is detected.

Figure 2:
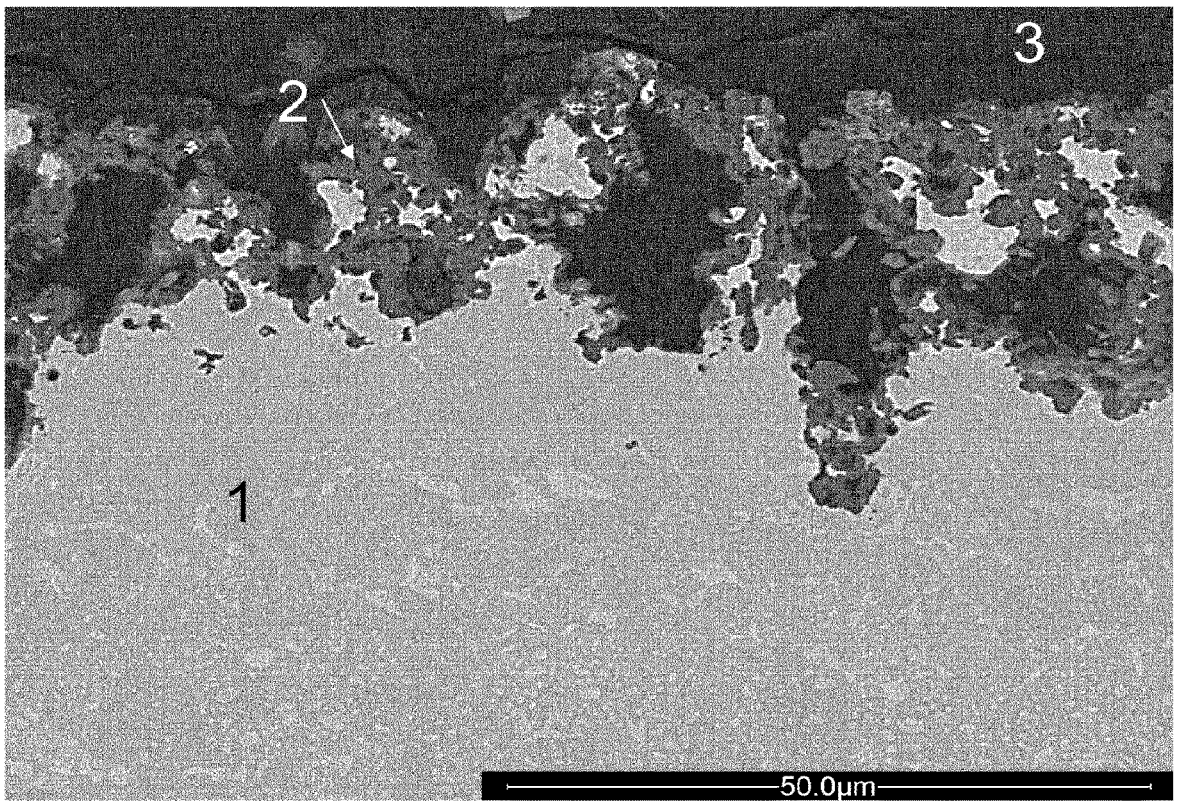
FIG. 2 is a magnification of FIG. 1

FIG. 2 shows a magnification of FIG. 1. Position 1: coating, Position 2: oxides, and position 3: mounting material.

Figure 3:
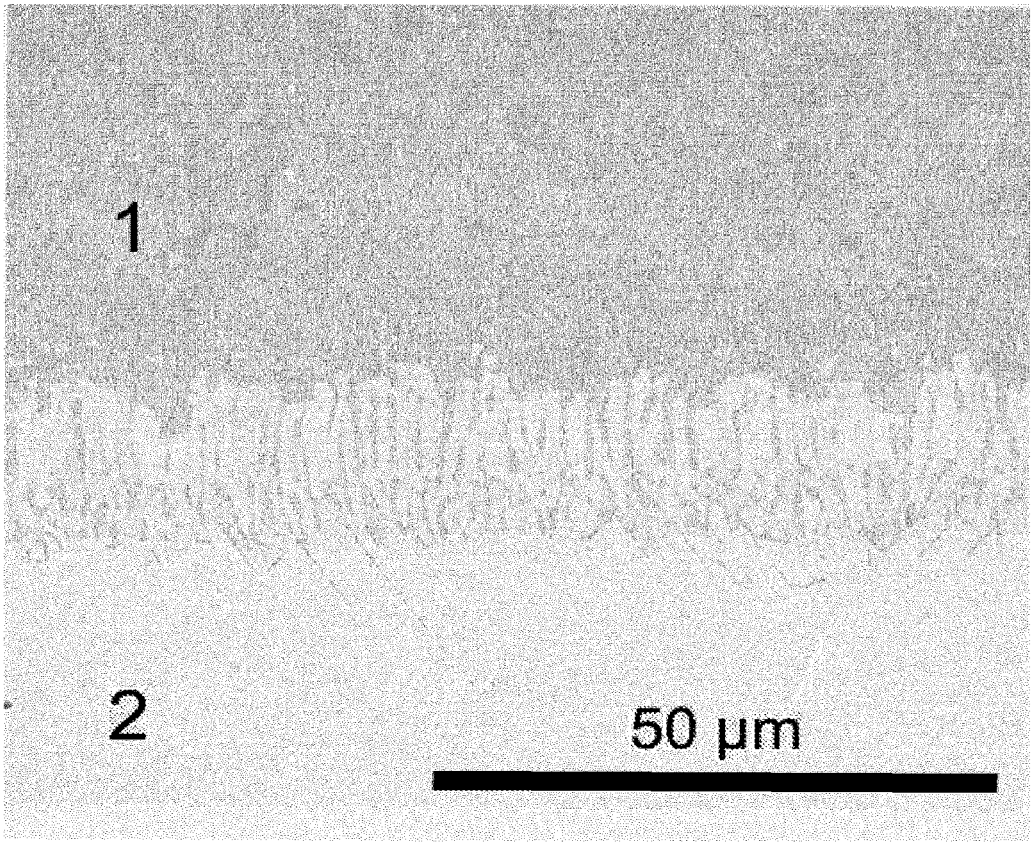
FIG. 3 is a magnification of the interface coating/base alloy.

FIG. 3 shows a magnification of FIG. 1 of the interface coating/base alloy. Position 1: coating, Position 2: base alloy.

Interdiffusion is measured as changes in the Ni/Al ratio in the coating, compared to the original Ni/Al ratio. With time, Ni diffuses from the base metal into the coating and Al diffuses from the coating into the base metal alloy. Depending on the diffusion rate of Ni and Al, the ratio Ni/Al changes with time. If the Ni/Al increases significantly with time the resistance to metal dusting changes; experiments have shown that the coating becomes less resistant against metal dusting.

The best coating is considered to be the one with most constant Ni/Al with time, because it will show the slowest interdiffusion.

Figure 4:
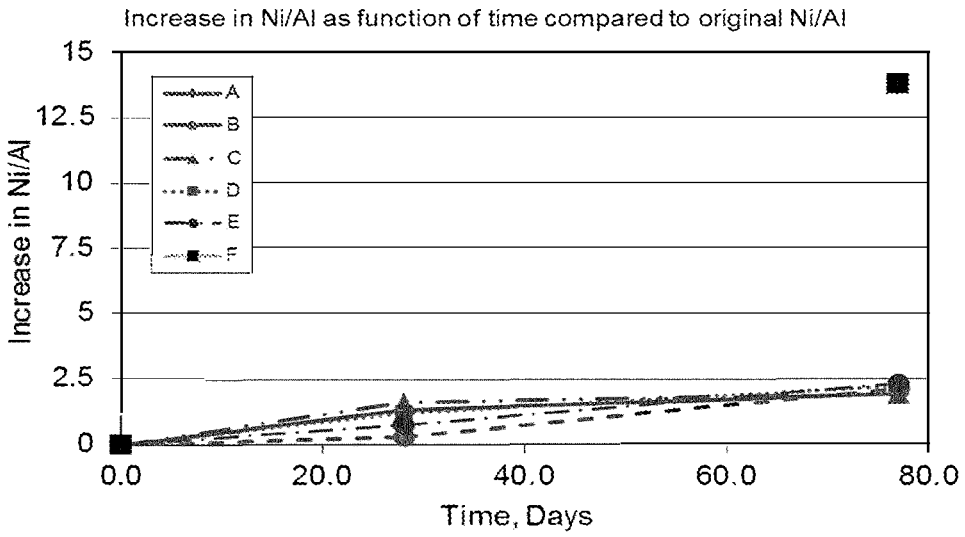
FIG. 4 shows the interdiffusion rate of six compositions.

FIG. 4 shows that composition F has a high interdiffusion rate compared to the other five.

Figure 5:
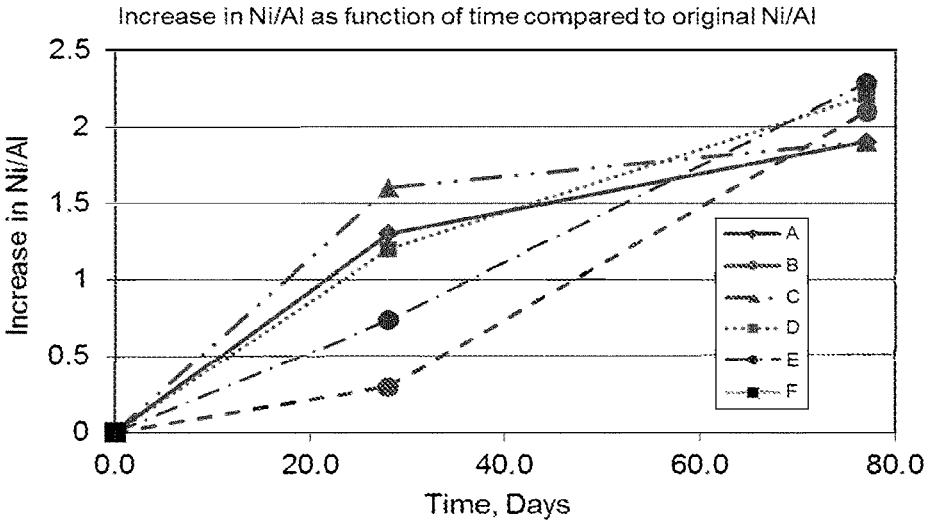
FIG. 5 is a magnification of FIG. 4 to compare five of the six compositions.

FIG. 5 enlarges the scale to compare compositions A-E. Compositions B, D and E show linear growth with time and are therefore not as advantageous as compositions A and C, which show a slight increase in the beginning, but remain stable after that. Compositions close to A and C will be preferred.

EXAMPLE

Metal dusting test of coated Ni-based alloy bars in the temperature range from 200 to 800° C. under very aggressive conditions with very low steam/carbon, under pressure 28.5 bar (g) for five weeks. The coating had been applied and heat treated in the range described in the invention. The thickness of the coating in the range 50-200 μm were tested. The coated Ni-based alloy bars did not show any metal dusting after 5 weeks, as compared to not-coated Inconel 601 bars which show metal dusting after less than one week.

The invention claimed is:

1. A Ni-based alloy coated with a chromium (Cr) free silicate-based nickel aluminide water based slurry diffusion coating, wherein a 10-1000 μm thick silicate-based Al containing slurry is applied on the Ni-based alloy, followed by heat treatment of the applied silicate-based Al containing slurry, wherein the heat treatment is performed in a reducing atmosphere of 80-100% Argon and 0-20% Hydrogen.

2. The Ni-based alloy coated with a chromium (Cr) free silicate-based nickel aluminide water based slurry diffusion coating of claim 1, wherein the Ni-based alloy is coated by slurry spray, paint brush or immersion.

3. A method for production of a chromium (Cr) free silicate-based nickel aluminide water based slurry diffusion coating on a Ni-based alloy for protection against high temperature corrosion caused by metal dusting, the method comprising the steps of:

applying a 10-1000 μm thick chromium free silicate-based nickel Al containing water based slurry on the Ni-based alloy; and heat treating the Ni-based alloy with the applied chromium free silicate-based nickel Al containing slurry in a reducing atmosphere of 80-100% Argon and 0-20% Hydrogen.

4. The method of claim 3, wherein the Ni-based alloy is coated by slurry spray, paint brush, or immersion.

* * * * *